US005454200A

United States Patent [19]

Hohmann

[11] Patent Number: 5,454,200

[45] **Date of Patent: * Oct. 3, 1995**

[54] VENEER ANCHORING SYSTEM

[76] Inventor: Ronald P. Hohmann, 32 Stratford Pl., Syosset, N.Y. 11791

[ * ] Notice: The portion of the term of this patent subsequent to Apr. 25, 2012 has been disclaimed.

[21] Appl. No.: 145,584

[22] Filed: Nov. 4, 1993

[51] Int. Cl.[6] ..... E04B 5/00; E04B 1/38

[52] U.S. Cl. ..... 52/513; 52/713; 52/712; 52/379

[58] Field of Search ..... 52/513 R, 379, 52/712, 713

[56] References Cited

U.S. PATENT DOCUMENTS

| | | | |
|---|---|---|---|
| 3,277,626 | 10/1966 | Brynjolfsson et al. | 52/713 |
| 3,309,828 | 3/1967 | Tribble | 52/713 |
| 3,341,998 | 9/1967 | Lucas | 52/379 |
| 3,494,090 | 2/1970 | Allen | 52/713 |
| 3,964,226 | 6/1976 | Hala et al. | 52/713 X |
| 4,660,342 | 4/1987 | Salisbury | 52/379 |
| 4,852,320 | 8/1989 | Ballantyne | 52/513 X |
| 4,955,172 | 9/1990 | Pierson | 52/379 X |
| 4,970,842 | 11/1990 | Kappeler et al. | 52/712 X |
| 5,207,043 | 5/1993 | McGee et al. | 52/379 |

*Primary Examiner*—Carl D. Friedman
*Assistant Examiner*—Wynn Wood

[57] ABSTRACT

A veneer anchoring system for use in the construction of a wall having an inner masonry wythe and an outer facing wythe is disclosed. A combination of a masonry anchor, a wall tie member, and a facing anchor is provided. The primary components of the system are reinforcing wire and wire formatives providing wire-to-wire connections therebetween. When the inner wythe is constructed from a masonry block material, the masonry anchor has a truss portion with eye wire extensions welded thereto. The eye wires extend into a cavity between the wythes. Each pair of eye wires accommodates the threading thereonto of a wire wall tie through the open end of the wall tie. The wall tie is then positioned so that the open end is utilizable as part of the facing anchor. The masonry anchor is embdedded in a bed joint of the interior wythe. The facing anchor has a straight wire run and mounted along the exterior wythe to receive the open end of wire wall tie with each leg thereof being placed adjacent one side of reinforcement wire. The facing anchor is embedded in a bed joint of the exterior wythe. Because the eye wires have sealed eyelets or loops and the open ends of the wall ties are sealed in the joints of the exterior wythes, a positive interengagement results. When the inner wythe is dry wall construct, a dry wall anchor, which is a stamped metal unit, is attached to the metal vertical channel members of the wall. Each wall anchor accommodates the threading therethrough of a wire wall tie. As the dry wall anchor is a closed loop and the open ends of the wall ties are sealed in the exterior wythe, a positive interengagement results.

14 Claims, 6 Drawing Sheets

VENEER ANCHORING SYSTEM

BACKGROUND OF THE INVENTION

1. Field of the Invention

This invention relates to an improved veneer anchoring system for use in conjunction with a wall structure having an inner wythe and an outer wythe. More particularly, to construction techniques for embedding a continuous wire in the bed joints of the outer wythe and having a positive interlocking arrangement. The invention is applicable to an outer wythe of brick facing in combination with an inner wythe of masonry block or dry wall construction.

2. Information Disclosure Statement

In the past, investigations relating to the effects of various forces, particularly lateral forces, upon brick veneer masonry construction demonstrated the advantages of having a continuous wire embedded in the mortar joint of anchored veneer walls. The seismic aspect of these investigations were referenced in the inventor's prior patent, namely U.S. Pat. No. 4,875,319. Besides earthquake protection, the failure of several high-rise buildings to withstand wind and other lateral forces has resulted in the incorporation of a requirement for continuous wire reinforcement in the Uniform Building Code provisions. The inventor's related Seismiclip® and DW-10-X® products (manufactured by Hohmann & Barnard, Inc., Hauppauge, N.Y. 11788) has become widely accepted in the industry. The use of a continuous wire in masonry veneer walls has also been found to provide protection against problems arising from thermal expansion and contraction and improving the uniformity of the distribution of lateral forces in a structure.

The following patents are believed to be relevant and are disclosed as being known to the inventor hereof:

| Patent | Inventor | Issue Date |
|---|---|---|
| 3,377,764 | Storch | 04/16/1968 |
| 4,021,990 | Schwalberg | 05/10/1977 |
| 4,373,114 | Allan | 02/15/1983 |
| 4,473,984 | Lopez | 10/02/1984 |
| 4,869,038 | Catani | 09/26/1989 |
| 4,875,319 | Hohmann | 10/24/1989 |

It is noted that these devices are generally descriptive of wire-to-wire anchors and wall ties and have various cooperative functional relationships with straight wire runs embedded in the interior and/or exterior wythe. Several of the prior art items are of the pintle and eyelet/loop variety without positive restriction against escape by vertical displacement.

U.S. Pat. No. 3,377,764 - D. Storch - Issued Apr. 16, 1968

Discloses a bent wire, tie-type anchor for embedment in a facing exterior wythe engaging with a loop attached to a straight wire run in a backup interior wythe.

U.S. Pat No. 4,021,990 - B. J. Schwalberg - Issued May 10, 1977

Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat. No. 4,373,314 - J. A. Allan - Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984 - Lopez - Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038 - M. J. Catani - Issued Sep. 26, 1989

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319 - R. Hohmann - Issued Oct. 24, 1989

Discloses a seismic constructuion system for anchoring a facing veneer to wallboard/metal stud construction with a pronged sheet-metal anchor. Wall tie is distinguished over that of Schwalberg '990 and is clipped onto a straight wire run.

None of the above provide the masonry construction system for an inner masonry wythe and an outer facing wythe having a fixed interconnection on the inner wythe and a precision interlock on the outer wythe as described hereinbelow.

SUMMARY

In general terms, the invention disclosed hereby includes a veneer anchoring system for use in the construction of a wall having an inner masonry wythe and an outer facing wythe. The wythes are in a spaced apart relationship and form a cavity therebetween. In the disclosed system, a unique combination of a masonry anchor, a wall tie member, and a facing anchor is provided. The invention contemplates that the primary components of the system are reinforcing wire and wire formatives providing wire-to-wire connections therebetween.

In the mode of practicing the invention wherein the inner wythe is constructed from a masonry block material, the masonry anchor has a truss portion with eye wire extensions welded thereto. The eye wires extend into the cavity between the wythes. Each pair of eye wires accommodates the threading thereonto of a wire wall tie through the open end of the wall tie. The wall tie is then positioned so that the open end is utilizable as part of the facing anchor. The masonry anchor is embdedded in a bed joint of the interior wythe. The facing anchor has a straight wire run and mounted along the exterior wythe to receive the open end of wire wall tie with each leg thereof being placed adjacent one side of reinforcement wire. The facing anchor is embedded in a bed joint of the exterior wythe. Because the eye wires have sealed eyelets or loops and the open ends of the wall ties are sealed in the joints of the exterior wythes, a positive interengagement results.

In the mode of practicing the invention wherein the inner wythe is a dry wall construct, a dry wall anchor, which is a stamped metal unit, is attached by sheetmetal screws to the metal vertical channel members of the wall. Each wall anchor accommodates in an opening therethrough the threading of a wire wall tie. As in the case of the masonry inner wythe, the open end of the wall tie is then positioned so that the open end is utilizable as part of the facing anchor. The facing anchor has a straight wire run and is mounted along the exterior wythe to receive the open end of wire wall tie with each leg thereof being placed adjacent one side of reinforcement wire. The facing anchor is embedded in a joint of the exterior wythe. Because the dry wall anchor opening is a closed loop and the open ends of the wall ties are sealed in the joints of the exterior wythes, a positive interengagement results.

OBJECT AND FEATURES OF THE INVENTION

It is an object of the present invention to provide in a wall structure having a facing wythe and a backup wythe, a veneer anchor system which employs a continuous wire reinforcement in the mortar joint of the facing wythe and is positively interconnected with a wall anchor attached to the backup wythe.

It is another object of the present invention to provide labor-saving devices to aid in the installation of brick and stone veneer and the securement thereof to an inner wythe.

It is yet another object of the present invention to provide a veneer anchor system which ties together the continuous wire reinforcement in a positive manner such that the connective portion in the cavity between the wythes cannot separate.

It is a further object of the present invention to provide a veneer anchor system comprising a limited number of component parts that are economical of manufacture resulting in a relatively low unit cost.

It is yet another object of the present invention to provide a veneer anchor system which restricts lateral movement of the facing wythe with respect to the inner wythe, but is adjustable horizontally and optionally vertically.

It is a feature of the present invention that the wall tie, after being threadedly inserted into a wall anchor, has a reinforcement wire nested therewithin and a portion of the wall tie including the reinforcement wire is embedded in a joint of the facing wythe.

It is another feature of the present invention that the wall tie is utilizable with a loop-type wall anchor for a masonry block inner wythe having aligned bed joints; or with elongated eye wire wall anchor for a masonry block having unaligned bed joints; or with a dry wall anchor that secures to a metal studs.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
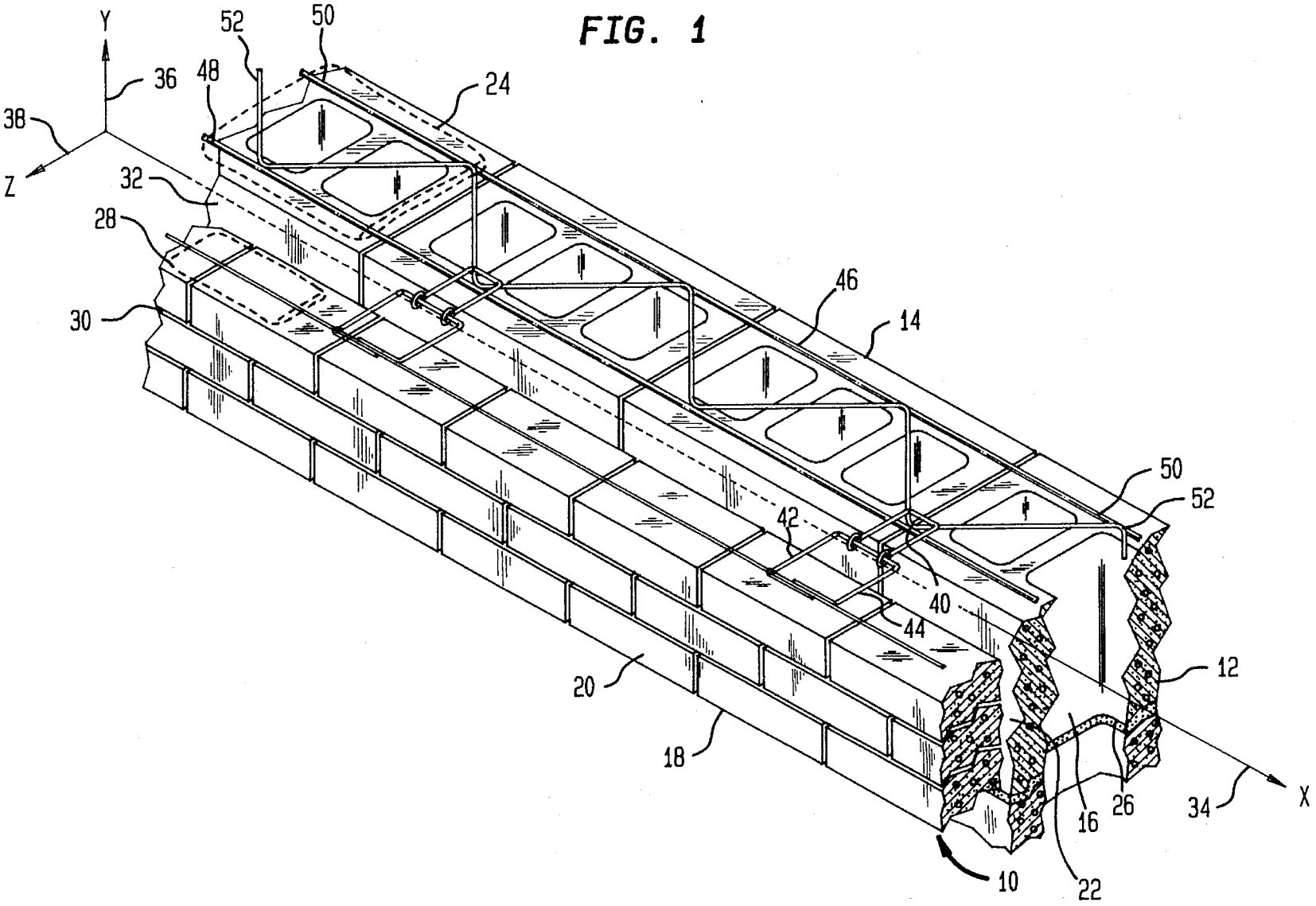
FIG. 1 is a perspective view of a first embodiment of a veneer anchoring system and shows a wall with an interior wythe of masonry block and an exterior wythe of brick, each having selected bed joints in alignment with one another.
Figure 2:
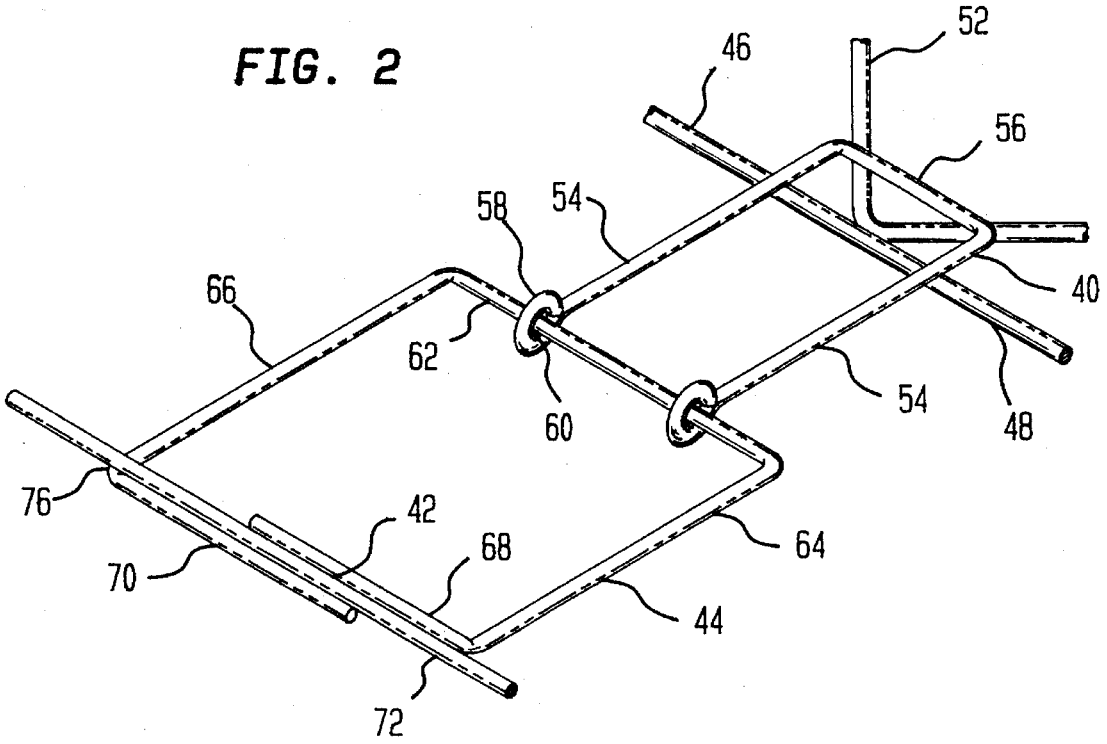
FIG. 2 is a partial perspective view of FIG. 1 showing the wall anchor, the wall tie, and the reinforcement wire.
Figure 3:
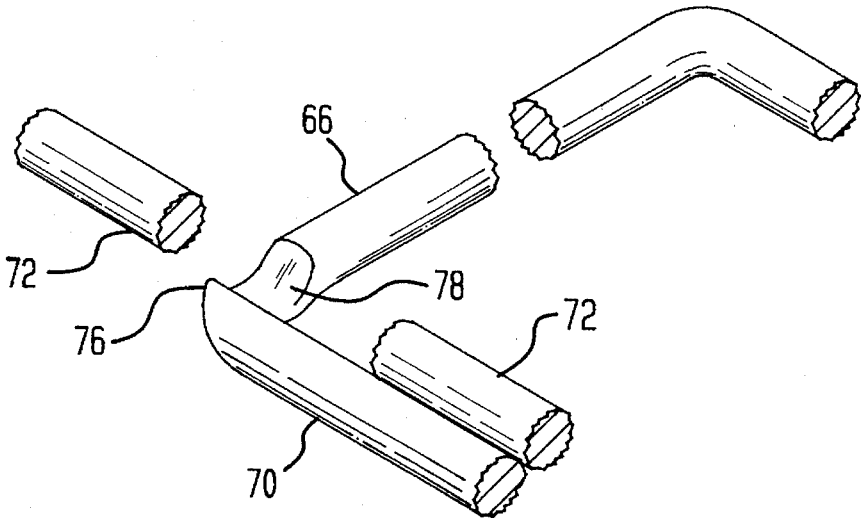
FIG. 3 is a partial perspective view of the wall tie and reinforcement wire of FIG. 2.

Referring now to FIGS. 1 to 3, the first embodiment of a masonry construction system of this invention is shown and is referred to generally by the numeral 10. In this embodiment, a wall structure 12 is shown having an interior wythe 14 of masonry blocks 16 and an exterior wythe 18 of facing brick 20. Between the interior wythe 14 and the exterior wythe 18, a cavity 22 is formed. In the first embodiment, successive bed joints 24 and 26 are formed between courses of blocks 16 and the joints are substantially planar and horizontally disposed. Also, successive bed joints 28 and 30 are formed between courses of bricks 20 and the joints are substantially planar and horizontally disposed. Selected bed joint 24 and bed joint 28 are constructed to align, that is to be substantially coplanar, the one with the other. For purposes of discussion, the exterior surface 32 of the interior wythe 14 contains a horizontal line or x-axis 34 and an intersecting vertical line or y-axis 36. A horizontal line or z-axis 38 also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the y-axis. The system 10 includes a masonry anchor 40 constructed for embedment in bed joint 24, a facing anchor 42 constructed for embedment in bed joint 28 and an interconnecting wall tie member 44.

The masonry anchor 40 is shown in FIG. 1 as being emplaced on a course of blocks 16 in preparation for embedment in the mortar of bed joint 24. In the best mode of practicing the invention, a truss or reinforcement wire portion 46 is constructed of a wire formative with two parallel continuous straight wire members 48 and 50 spaced so as, upon installation, to each be centered along the outer walls of the masonry blocks 16. An intermediate wire body or wire 52 is interposed therebetween and connects wire members 48 and 50 forming chord-like portions of the truss 46. At intervals along the truss 46, spaced pairs of transverse wire members 54 are attached thereto and are attached to each other by a rear leg 56 therebetween. These pairs of wire members 54 extend into the cavity 22. As will become clear by the description which follows, the spacing therebetween is constructed to limit the x-axis movement of the construct. Each transverse wire member 54 has at the end opposite the attachment end an eye wire portion 58 formed continuous therewith. A sheetmetal loop is an alternative construction in lieu of eye wires shown in the best mode; however, the wire formative has been found to be structurally superior. Upon installation, the eye 60 of eye wire portion 58 is constructed to be within a substantially vertical plane normal to exterior surface 32. The eye 60 is dimensioned to accept a wall tie threadedly therethrough and is thus slightly larger than the diameter of the tie. This relationship minimizes the y- and z-axis movement of the construct. For positive engagement, the eye 60 of eye wire portion 58 is sealed forming a closed loop.

The wall tie 44 is generally rectangular in shape and is dimensioned to be accommodated by a pair of eye wires 58 previously described. The wall tie 44 has a rear leg portion 62, two parallel side leg portions 64 and 66, and two parallel front leg portions 68 and 70. To facilitate installation, the front leg portions 68 and 70 are spaced apart at least by the diameter of the wire member 54. The longitudinal axes of leg portions 62, 64, 66, 68 and 70 are substantially coplanar. The side leg portions 64 and 66 are structured to function cooperatively with the spacing of transverse wire members 54 to limit the x-axis movement of the construct.

The front leg portions 68 and 70 have parallel coplanar axes which, as will be seen in the description that follows, are spaced to accommodate therebetween the reinforcement wire or straight wire member 72 of predetermined diameter. The front leg portion 68 is attached to side leg portion 64 and is structured to be posited on the interior side of the reinforcement wire while exerting slight pressure thereon. The front leg portion 70 is attached to side leg portion 66 and is structured to position on the exterior side of the reinforcement wire while exerting slight pressure thereon. Adjacent the juncture of front leg portion 70 and side leg portion 66, an overpass connector portion 76 is formed in side leg portion 66. While the connector 76 is shown as ramping upwardly on the interior side to a flattened overarching portion 78 and as ramping downwardly on the exterior side, a reverse configuration may optionally be employed. Whatever configuration is used, care is exercised that the bed joint 28 height specification is readily maintained. While the physical description of the wall tie structure is provided hereinabove, the functional attributes are now provided so that the appended claims may more readily be understood. When viewing the wall tie as installed, there is a portion thereof 62, part of 64, and part of 66, or a first end portion, which spans from the eye wires to the interior face of the outer facing wythe and there is a portion thereof part of 64, part of 66, 68, 70, and 76 or a second end portion, which extends inwardly into the outer facing wythe from the interior face thereof. Functionally, the pair of front leg portions 68 and 70 is considered for claim purposes a base portion; and, leg portion 62, a top portion.

Figure 5:
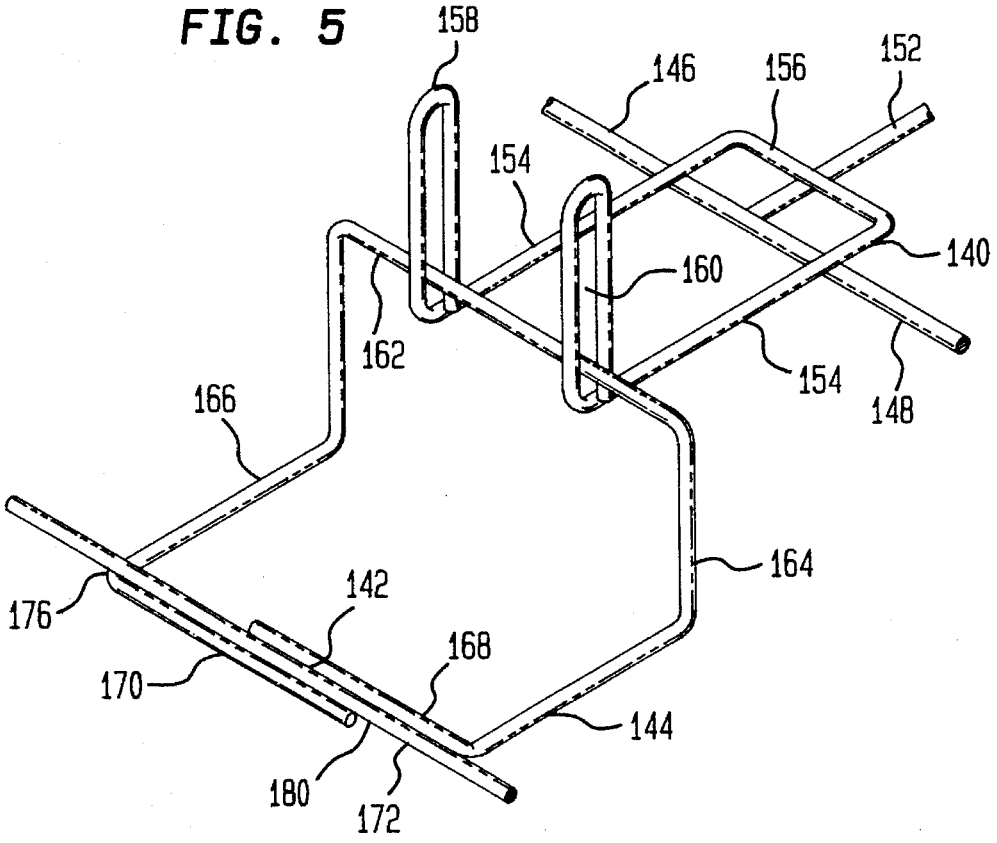
FIG. 5 is a partial perspective view of FIG. 4 showing the wall anchor, the wall tie, and the reinforcement wire.
Figure 6:
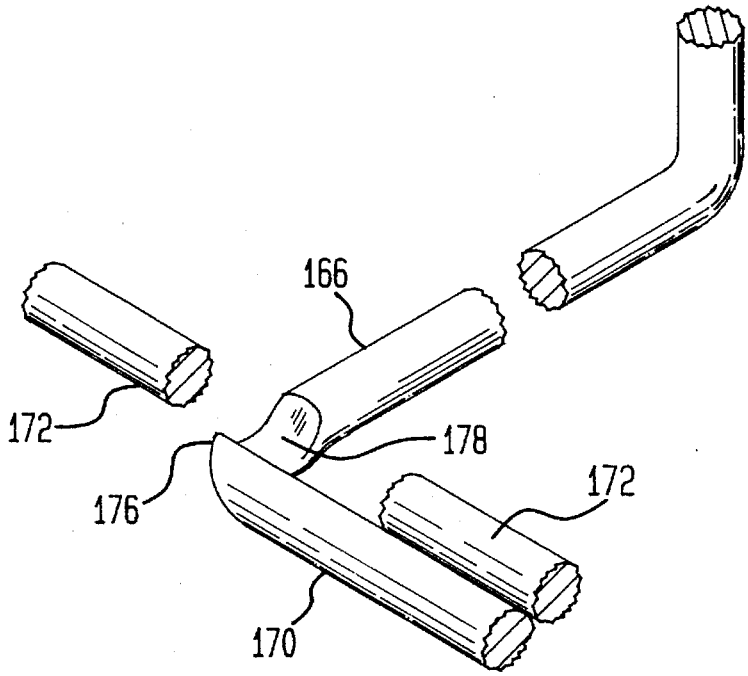
FIG. 6 is a partial perspective view of the wall tie and reinforcement wire of FIG. 5.
Figure 4:
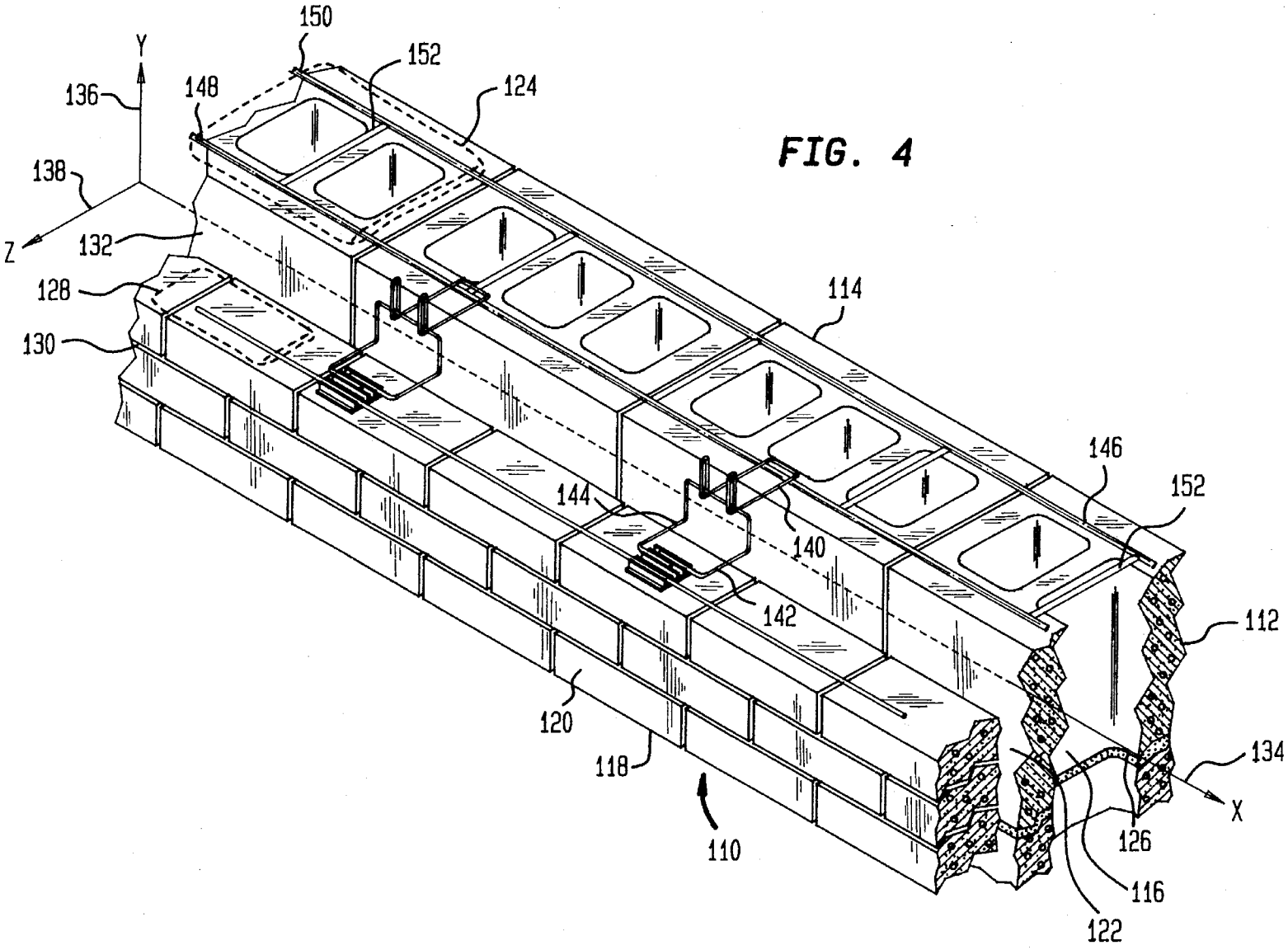
FIG. 4 is a perspective view of a second embodiment of a veneer anchoring system and shows a wall with an interior wythe of masonry block and an exterior wythe of brick without aligned bed joints.

The description which follows is of a second embodiment of the masonry construction system. For ease of comprehension, where similar parts are used reference designators "100" units higher are employed. Thus, the wall tie 144 of the second embodiment is analogous to the wall tie 44 of the first embodiment. Referring now to FIGS. 4 to 6, the second embodiment of a masonry construction system of this invention is shown and is referred to generally by the numeral 110. As in the first embodiment, a wall structure 112 is shown having an interior wythe 114 of masonry blocks 116 and an exterior wythe 118 of facing brick 120. Between the interior wythe 114 and the exterior wythe 118, a cavity 122 is formed. Successive bed joints 124 and 126 are formed between courses of blocks 116 and the joints are substantially planar and horizontally disposed. Also, successive bed joints 128 and 130 are formed between courses of bricks 120 and the joints are substantially planar and horizontally disposed. Selected bed joint 124 and bed joint 128 are constructed to be interconnected utilizing the construct hereof; however, the joints 124 and 128 are unaligned. For purposes of discussion, the exterior surface 132 of the interior wythe 114 contains a horizontal line or x-axis 134 and an intersecting vertical line or y-axis 136. A horizontal line or z-axis 138 also passes through the coordinate origin formed by the intersecting x- and y-axes. The system 110 includes a masonry anchor 140 constructed for embedment in bed joint 124, a facing anchor 142 constructed for embedment in bed joint 128 and an interconnecting wall tie member 144.

The masonry anchor 140 is shown in FIG. 4 as being emplaced on a course of blocks 116 in preparation for embedment in the mortar of bed joint 124. In this embodiment, a ladder type reinforcement wire portion 146 is constructed of a wire formative with two parallel continuous straight wire members 148 and 150 spaced so as, upon installation, to each be centered along the outer walls of the masonry blocks 116. An intermediate wire body or a plurality of wires 152 are interposed therebetween and connect wire members 148 and 150 forming rung-like portions of the ladder-type reinforcement 146. At intervals along the ladder-type reinforcement 146, spaced pairs of transverse wire members 154 are attached thereto and are attached to each other by a rear leg 156 therebetween. These pairs of wire members 154 extend into the cavity 122. The spacing therebetween limits the x-axis movement of the construct. Each transverse wire member 154 has at the end opposite the attachment end an eye wire portion 158 formed continuous therewith. Upon installation, the eye 160 of eye wire portion 158 is constructed to be within a substantially vertical plane normal to exterior surface 132. The eye 160 is elongated vertically in both directions to accept a wall tie threadedly therethrough from the unaligned bed joint. The eye 160 is slightly larger horizontally than the diameter of the tie. This dimensional relationship minimizes the z-axis movement of the construct. For positive engagement, the eye 160 of eye wire portion 158 is sealed forming a closed loop.

The wall tie or bent-box tie 144 is, when viewed from a top, front, rear, or bottom elevation, generally rectangular in shape and is, when viewed from right or left side elevation, is generally L-shaped. The bent-box wall tie 144 is dimensioned to be accommodated by a pair of eye wire portions 158 described, supra. The wall tie 144 has a rear leg portion 162, two parallel side leg portions 164 and 166, which are bent at right angles and attached to the rear leg portions 162 at one end thereof, and two parallel front leg portions 168 and 170. To facilitate installation, the front leg portions 168 and 170 are spaced apart at least by the diameter of the wire member 154. The longitudinal axes of leg portions 166 and 168 and the longitudinal axes of the contiguous portions of the side leg portions 164 and 166 are substantially coplanar. The side leg portions 164 are structured to function cooperatively with the spacing of transverse wire members 154 to limit the x-axis movement of the construct. The bent box tie 144 is constructed so that with insertion through eye 160, the misalignment tolerated is approximately one-half the vertical spacing between adjacent bed joints of the facing brick course. Here of course, it is realized that the bent box tie 144 is mountable with the rear portion thereof extending downwardly toward eye 160 or extending upwardly toward eye 160.

The facing anchor 142 is constructed from a straight wire member 172 and an anchor portion 174 of the wall tie 144 which, when installed, lies within the exterior wythe 118. The spacing forming a channel 180 between legs 168 and 170 and through connector 176 is selectively dimensioned such that a wire member 172 of a comparable preselected diameter may be inserted in the appropriate sized channel. During the construction of the exterior wythe 118, the mortar also fills the channel 180 and the interstices between the wall tie 144 and the straight wire member 172 thereby bonding together the components and sealing the opening of the wall tie member 144.

The description which follows is of a third embodiment of the masonry construction system. For ease of comprehension, where similar parts are used reference designators "200" units higher are employed. Thus, the wall tie 244 of the third embodiment is analogous to the wall tie 44 of the first embodiment.

Figure 7:
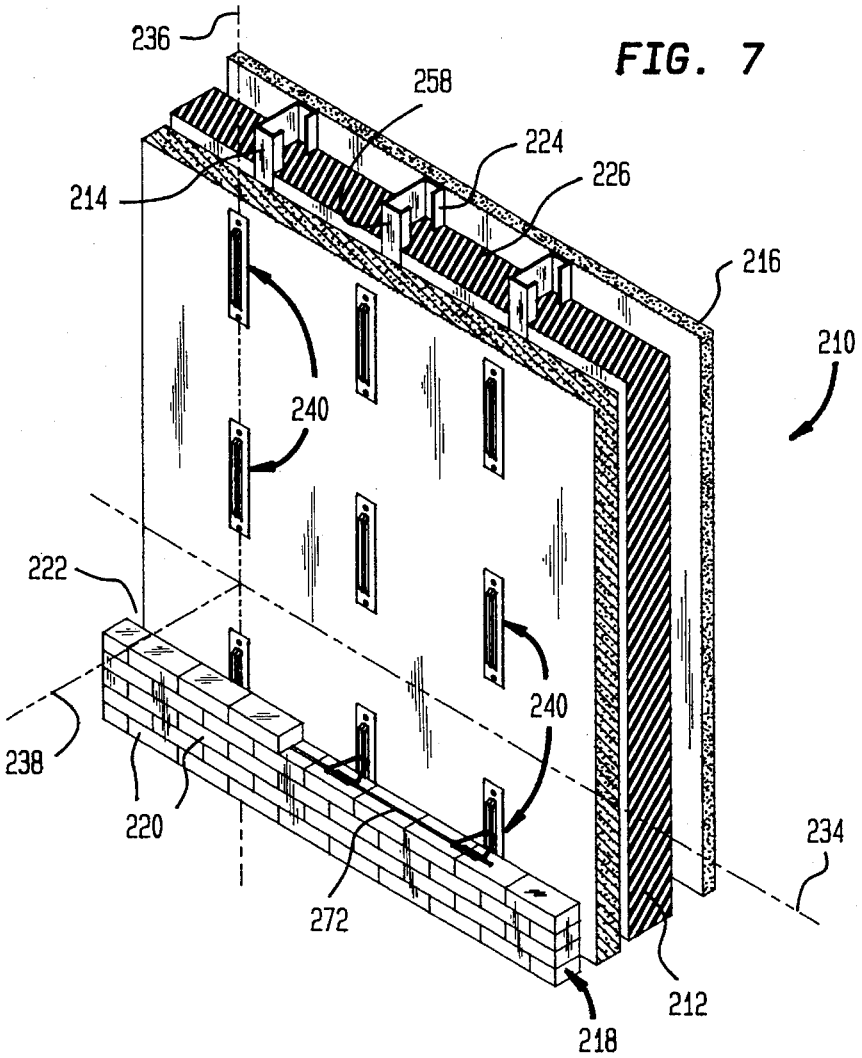
FIG. 7 is a perspective view of a third embodiment of a veneer anchoring system and shows a wall with a dry wall interior wythe and a brick exterior wythe.
Figure 8:
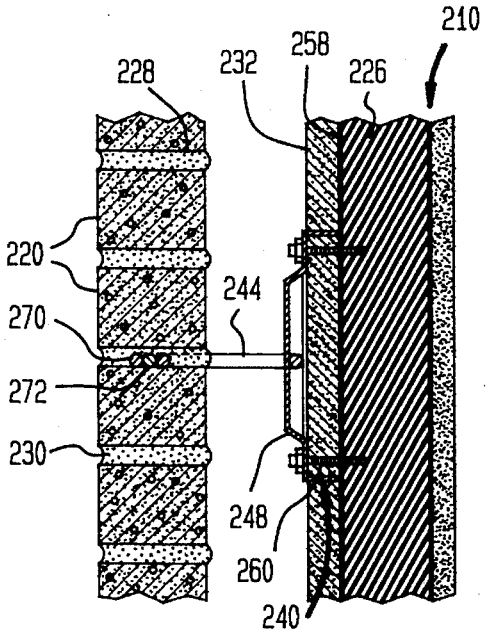
FIG. 8 is a partial perspective view of FIG. 7 showing the wall anchor, the wall tie, and the reinforcement wire; and, FIG. 9 is a partial perspective view of the wall tie and the reinforcement wire of FIG. 8.
Figure 9:
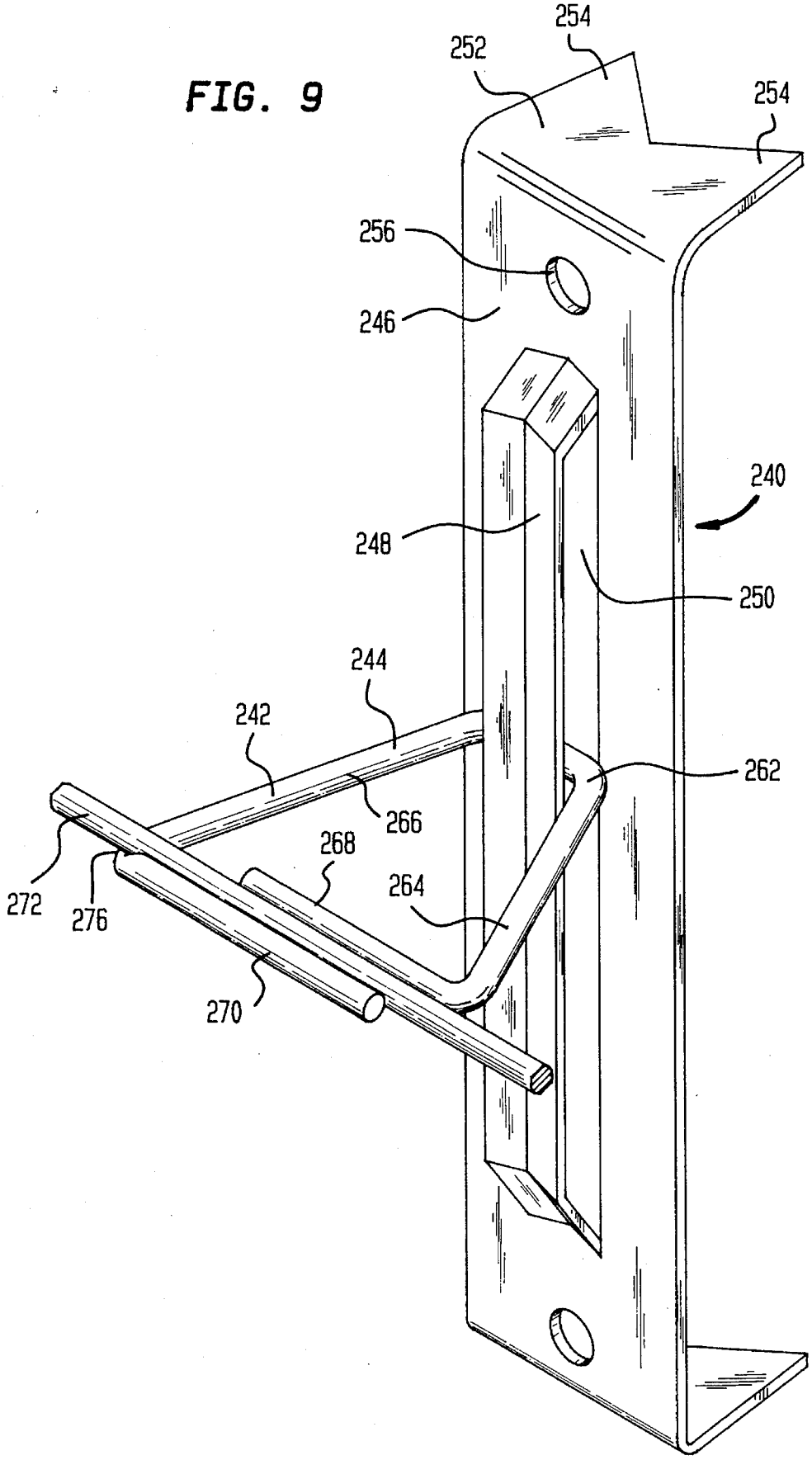

Referring now to FIGS. 7 to 9, the third embodiment of the masonry construction system is shown and is referred to generally by the numeral 210. The construction system 210 employs the pronged veneer anchor construction first described in U.S. Pat. No. 4,598,518 and marketed by Hohmann and Barnard, Inc., Hauppauge, N.Y. 11788 under the trademark "DW-10-X". The dry wall structure 212 is shown having an interior wythe 214 with a wallboard 216 as the interior and exterior facings thereof. An exterior wythe 218 of facing brick 220 is attached to dry wall structure 212 and a cavity 222 is formed therebetween. The dry wall structure 212 is constructed to include, besides the wallboard facings 216, vertical channels 224 with insulation layers 226 disposed between adjacent channel members 224. Selected bed joints 228 and 230 are constructed to be in cooperative functional relationship with the wall anchor described in more detail below. For purposes of discussion, the exterior surface 232 of the interior wythe 214 contains a horizontal line or x-axis 234 and an intersecting vertical line or y-axis 236. A horizontal line or z-axis 238 also passes through the coordinate origin formed by the intersecting x- and y-axes. The system 210 includes a dry wall anchor 240 constructed for attachment to vertical channel members 224, a facing anchor 242 constructed for embedment in joint 228 and an interconnecting wall tie member 244.

Reference is now directed to the construction of the wall anchor or pronged veneer anchor 240 comprising a backing plate member 246 and a projecting bar portion 248. The projecting bar portion 248 is punched-out from the central portion of the stock plate member 246 so as to result in a centrally disposed aperture and, when viewed from the side elevation, a wall-tie-receiving slot 250. The aperture is substantially rectangular configuration and is formed in the plate member 246. The projecting bar portion 248 is thus disposed in substantially parallel relationship with respect to the plate member 246; however, the upper and lower ends of the projecting bar portion 248 are slightly angled to permit the full projection of the bar portion 248 with respect to the plate member 246. Secured to the upper and lower ends of the plate member 246 in a substantially perpendicular relationship are pronged end members 252 which are bifurcated to form prong portions or prongs 254. It is within the present invention to have the end members 252 formed with a single prong; however, for structural purposes of the bifurcated construction is preferred. The plate member 246 is also provided with bores 256 at the upper and lower ends thereof, the purpose and function of which will be discussed in more detail hereinbelow. As is best seen in FIG. 9, the projecting bar portion 248 is sufficiently spaced from the plate member 246 so as to form a slot 250 therebetween which is adapted to receive the wall tie 244 therewithin. In the fabrication of the dry wall as the inner wythe of this construction system 210, the channel members 224 are initially secured in place. In this regard, the channel members 224 may also comprise the standard framing members of a building. Sheets of exterior wallboard 216, which may be of an exterior grade gypsum board, are positioned in abutting relationship with the forward flange 258 of the channel member 224. While the insulating layer has herein been described as comprising a gypsum board, it is to be noted that any similarly suited rigid or flexible insulating material may be used herein with substantially equal efficacy. After the initial placement of the flexible insulation layer 226 and the wallboard 216, the veneer anchors 240 are secured to the surface of the wallboard 216 in front of channel members 224 by forcing the prongs 254 therein until the prongs 254 abuttingly engage the front flange 258 of the channel members 224. Thereafter, sheetmetal screws 260 are inserted into the bores 256 to fasten the anchor 240 to the flange 258 and to channel member 224.

The wall tie 244 is substantially a truncated triangularly shaped member and is dimensioned to be accommodated within slot 250 previously described. The wall tie 244 has a rear leg portion 262, two divergent side leg portions 264 and 266, and two parallel front leg portions 268 and 270. To facilitate installation, the front leg portions 268 and 270 are spaced apart at least by the thickness of the projecting bar portion 248. The longitudinal axes of leg portions 262, 264, 266, 268 and 270 are substantially coplanar. The side leg portions 264 and 266 are structured to function cooperatively with the width of the projecting bar portion 248 to limit the x-axis movement of the construct.

The front leg portions 268 and 270 have parallel coplanar axes which, as will be seen in the description that follows, are spaced to accommodate therebetween the reinforcement wire or straight wire member 272 of predetermined diameter. The front leg portion 268 is attached to side leg portion 264 and is structured to be posited on the interior side of the reinforcement wire while exerting slight pressure thereon. The front leg portion 270 is attached to side leg portion 266 and is structured to posited on the exterior side of the reinforcement wire while exerting slight pressure thereon. Adjacent the juncture of front leg portion 270 and side leg portion 266, an overpass connector portion 276 is formed in side leg portion 266. While the connector 276 is shown as ramping upwardly on the interior side to a flattened overarching portion 278 and as ramping downwardly on the exterior side, a reverse configuration may optionally be employed. Whatever configuration is used, care is exercised that the bed joint 228 height specification is readily maintained. As differentiated from the first two embodiments, the dry wall construction system 210 provides for the structural integrity by the securement of the veneer anchor construction to the channel member. The vertical adjustability and the limited horizontal movement of the wall tie 244 is been described in complete detail in U.S. Pat. Nos. 4,021,990 and 4,598,518 and reference is had thereto for further discussion of these features.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A veneer anchoring system for use in the construction of a wall having an inner masonry wythe formed from successive courses of blocks and an outer facing wythe formed from successive courses of bricks in spaced apart relationship forming a cavity therebetween, said anchoring system forming a wall resistant to lateral forces comprising, in combination:

a masonry anchor adapted to be embedded within said inner masonry wythe, in turn comprising:

a first reinforcement wire portion disposed longitudinally therein;

spaced pairs of transverse wire portions extending therefrom, each transverse wire portion attached at one end thereof to said first reinforcement wire portion and, when embedded in said inner masonry wythe, extending into said cavity and terminating therewithin;

an eye wire portion formed continuous with each said transverse wire portion and attached thereto at the end opposite the attachment end, said eye wire portion forming an eye adapted, when installed in said wall structure, to be disposed vertically in said cavity lying in a plane normal to the masonry wythe surface;

a wall tie member having a first end portion and a second end portion, said first end portion extending, when installed, from said eye wire portion to said outer facing wythe and being captively disposed in one pair of said eye wire portions and said second end portion disposed, when installed, upon said outer facing wythe and between said successive courses of brick thereof further comprising:

a pair of leg portions extending transverse the longitudinal aspect of said successive courses of brick;

a reinforcement wire capturing portion attached to one of said pair of leg portions, said capturing portion adapted to encapture therewithin a reinforcement wire longitudinally disposed on said outer facing wythe and dimensioned to accommodate a wire reinforcement in a nesting fashion;

at least one second reinforcement wire portion disposed longitudinally in said outer facing wythe and adapted to nest within said second end portion of said wall tie member;

whereby upon embedment of said masonry anchor in said inner masonry wythe, the captive disposition of the wall tie member in the eye wire portion thereof, and the embedment of said facing anchor with the second end portion of the wall tie member having said second reinforcement wire disposed therein, a reinforced construct is formed that is resistant to lateral forces.

2. A masonry construction system as described in claim 1 wherein said wall tie member further comprises:

a base portion within said second end portion attached to and coplanar with said pair of leg portions, said base portion having a pair of members, said members disposed substantially coplanar the one to the other; and, a top portion of said first end portion connecting the leg portions to one another, said leg portions, said base portion, and said top portion being substantially coplanar.

3. A masonry construction system as described in claim 2 wherein said inner masonry wythe is structured to rest on one of a plurality of substantially planar bed joints with successive layers thereof having bed joints substantially parallel thereto; said outer facing wythe is constructed of bricks resting upon one of a plurality of bed joints with successive layers thereof having bed joints substantially parallel thereto, with selected ones of said bed joints are substantially coplanar with selected bed joints of said inner masonry wythe.

4. A masonry construction system as described in claim 3 wherein said wall tie member is a wire formative and said eye is dimensioned to receive therewithin said wire formative with minimal axial endplay; and, said eye wire portion is sealed by forming a closed loop in the end thereof opposite the end attached to the transverse wire portion.

5. A masonry construction system as described in claim 4 wherein a horizontal line within the surface plane of the inner masonry wythe defines the x-axis, an intersecting vertical line within the surface plane of the masonry wythe defines the y-axis, and a line normal thereto and passing through the intersection defines the z-axis, said wall structure has substantially no y-axis and substantially no z-axis movement of the inner masonry wythe with respect to the outer facing wythe.

6. A masonry construction system as described in claim 5 wherein said first reinforcement wire portion is a single reinforcing wire.

7. A masonry construction system as described in claim 5 wherein said first reinforcement wire portion is a reinforcing wire truss.

8. A masonry construction system as described in claim 7 wherein said reinforcing wire truss further comprises:

a pair of reinforcing wires disposed parallel the one to the other, both adapted for embedment within a corresponding one of said bed joints of said inner masonry wythe;

a plurality of wire chords, each chord attached to both of said pair of reinforcement wires in a predetermined array.

9. A masonry construction system as described in claim 2 wherein said inner masonry wythe is structured to rest on one of a plurality of substantially planar bed joints with successive layers thereof having bed joints substantially parallel thereto; said outer facing wythe is constructed of bricks resting upon one of a plurality of bed joints with successive layers thereof having bed joints substantially parallel thereto, and wherein said bed joints are unaligned with said bed joints of said masonry wythe.

10. A masonry construction system described in claim 9 wherein said eyes, when installed in said wall structure, are vertically elongated with a horizontal opening therethrough dimensioned to receive therewithin said wall tie member with minimal interfacial endplay; and, wherein said eye wire portion is sealed by adhering the end thereof opposite the end attached to the transverse wire portion to a medial part of the eye wire portion thereby forming a closed loop.

11. A masonry construction system as described in claim 10 wherein a horizontal line within the surface plane of the inner masonry wythe defines the x-axis, an intersecting vertical line within the surface plane of the inner masonry wythe defines the y-axis, and a line normal thereto and passing through the intersection defines the z-axis, said wall structure has substantially no z-axis movement of the inner masonry wythe with respect to the outer facing wythe.

12. A wall tie for use with a veneer anchor construction system having an inner wythe and an outer wythe formed from successive courses of facing bricks in spaced apart relationship forming a cavity therebetween, said wall tie for cooperative functioning with a wall anchor of said system mounted to said inner wythe and comprising:

a wire formative having a first end portion and a second end portion, said first end portion adapted to extend, when installed, from said inner wythe across said cavity to said outer wythe and said second end portion adapted, when installed, for disposition upon said outer wythe and between said successive courses of facing brick, said wire formative further comprising:

a base portion;

a first pair of leg portions each attached at one end thereof to said base portion, and, when installed, extending substantially transverse to the facing brick;

a reinforcement wire capturing portion attached to one of said pair of leg portions, said capturing portion adapted to encapture therewithin a reinforcement wire longitudinally disposed on said outer facing wythe and dimensioned to accommodate a wire reinforcement in a nesting fashion;

a second pair of leg portions each attached to said first pair of leg portions at the end opposite said base portion, and, when installed, longitudinally disposed on said facing brick with each of said second pair adapted to extend along opposite sides of a longitudinally disposed reinforcement wire.

13. A wall tie for use with a veneer anchor construction system as described in claim 12 wherein said second pair of leg portions are substantially parallel the one to the other and spaced apart the one from the other by a predetermined spacing, said wall tie adapted to interlock with a closed loop of said wall anchor, said predetermined spacing selected to enable the wall tie to be threadingly inserted into the closed loop of said wall anchor.

14. A wall tie for use with a veneer anchor construction system as described in claim 13 wherein a horizontal line within the surface plane of the inner masonry wythe defines the x-axis, an intersecting vertical line within the surface plane of the masonry wythe defines the y-axis, and a line normal thereto and passing through the intersection defines the z-axis, said wall structure has substantially no y-axis and substantially no z-axis movement of the inner masonry wythe with respect to the outer facing wythe.

* * * * *